US005332101A

United States Patent [19]

Bakula

[11] Patent Number: 5,332,101

[45] Date of Patent: Jul. 26, 1994

[54] SCREEN ALIGNING, TENSIONING AND SEALING STRUCTURE FOR VIBRATORY SCREENING MACHINE

[75] Inventor: John J. Bakula, Grand Island, N.Y.

[73] Assignee: Derrick Manufacturing Corporation, Buffalo, N.Y.

[21] Appl. No.: 879,859

[22] Filed: May 6, 1992

[51] Int. Cl.[5] ..... B07B 1/49

[52] U.S. Cl. ..... 209/403; 209/405; 160/328; 160/378; 210/499

[58] Field of Search ..... 209/392, 402, 403, 404, 209/405, 409, 412, 413, 399; 210/232, 388, 499; 160/328, 378

[56] References Cited

U.S. PATENT DOCUMENTS

| | | | |
|---|---|---|---|
| 4,133,751 | 1/1979 | Stengel | 209/404 |
| 4,575,421 | 3/1986 | Derrick et al. | 209/397 |
| 4,582,597 | 4/1986 | Huber | 209/403 X |
| 4,819,809 | 4/1989 | Derrick | 209/392 X |
| 4,882,054 | 11/1989 | Derrick et al. | 210/389 |
| 5,028,324 | 7/1991 | Teinert | 209/403 X |

FOREIGN PATENT DOCUMENTS

| | | | |
|---|---|---|---|
| 2631255 | 11/1989 | France | 209/403 |
| 0957193 | 5/1964 | United Kingdom | 209/403 |

*Primary Examiner*—D. Glenn Dayoan
*Assistant Examiner*—Tuan N. Nguyen
*Attorney, Agent, or Firm*—Joseph P. Gastel

[57] ABSTRACT

A quick release draw bolt device including a bolt member, an end on the bolt member for exerting a pulling force on an external member, first and second body members mounted on the bolt member, a cam arrangement between the first and second body members for causing them to occupy relatively close and relatively remote positions relative to each other, and a spring arrangement mounted relative to the first and second body members for causing the bolt member to exert a pulling force when the first and second body members are in a relatively remote position and for releasing the pulling force when the first and second body members are in a relatively close position. An alignment structure for the screen of a vibratory screening machine including a notch on the channel end of a screen and a cooperating tab on the drawbar which engages the channel. A balloon seal for attachment to the edge of a vibratory screen for sealing the space between the edge and the bed of the machine.

31 Claims, 9 Drawing Sheets

Fig. 8.
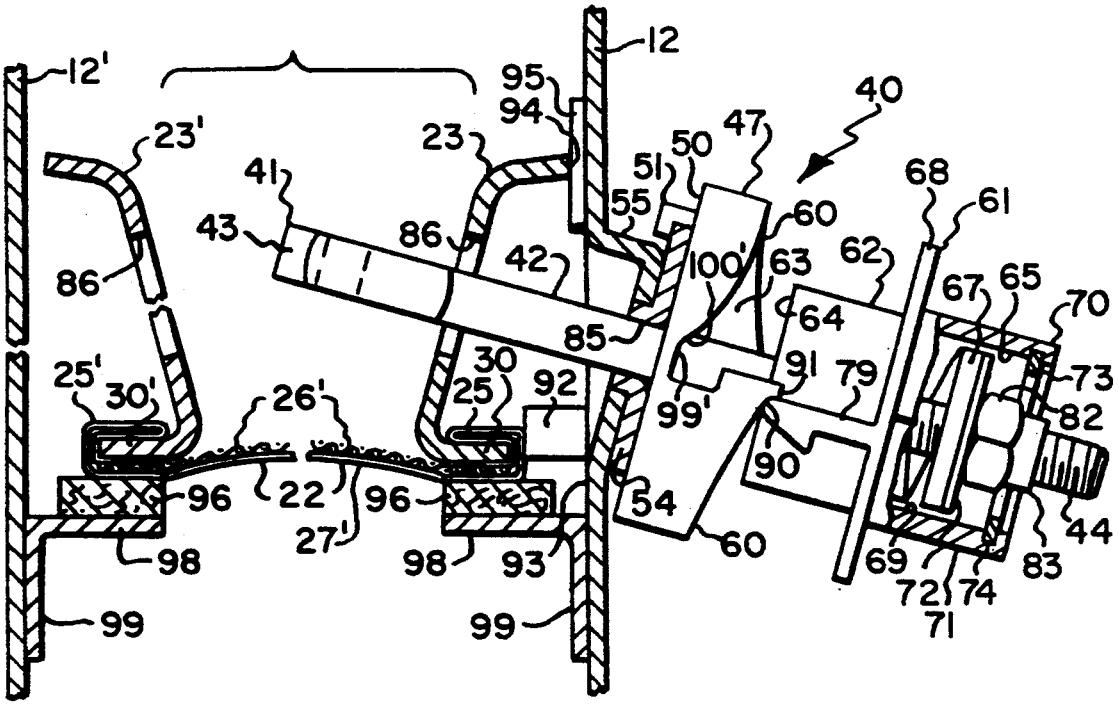
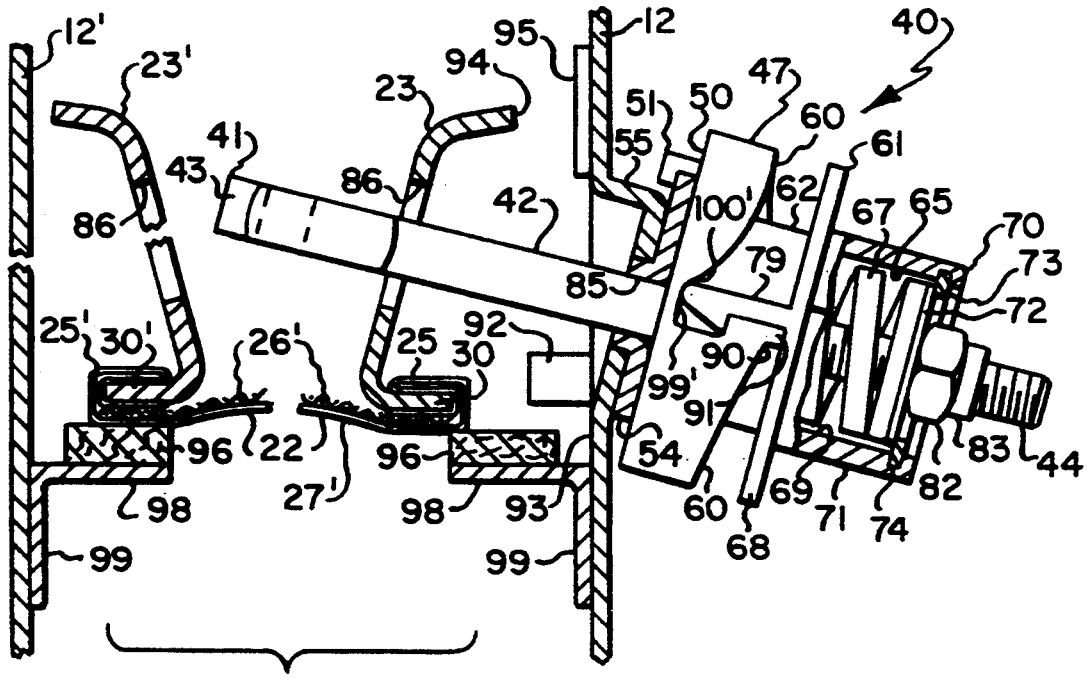
Fig. 10.

Fig. 14.
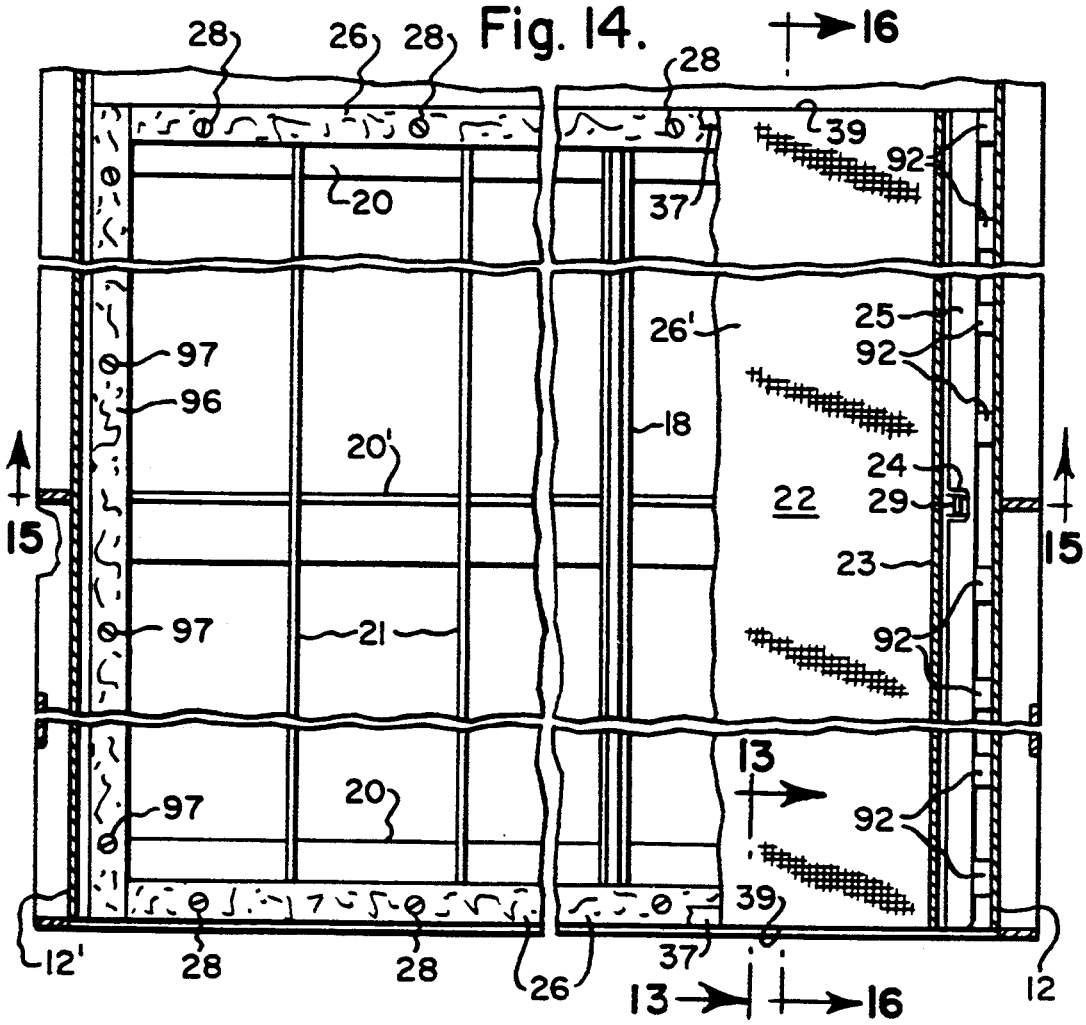
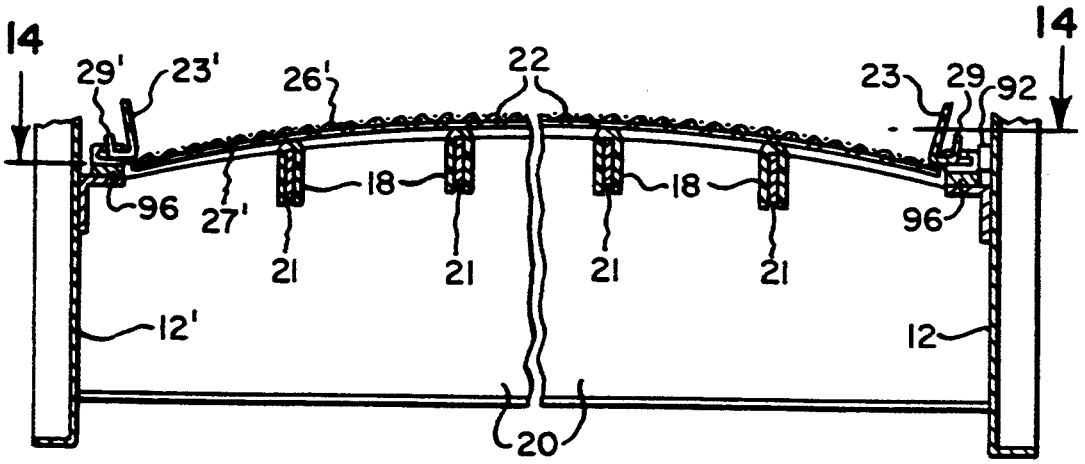
Fig. 15.

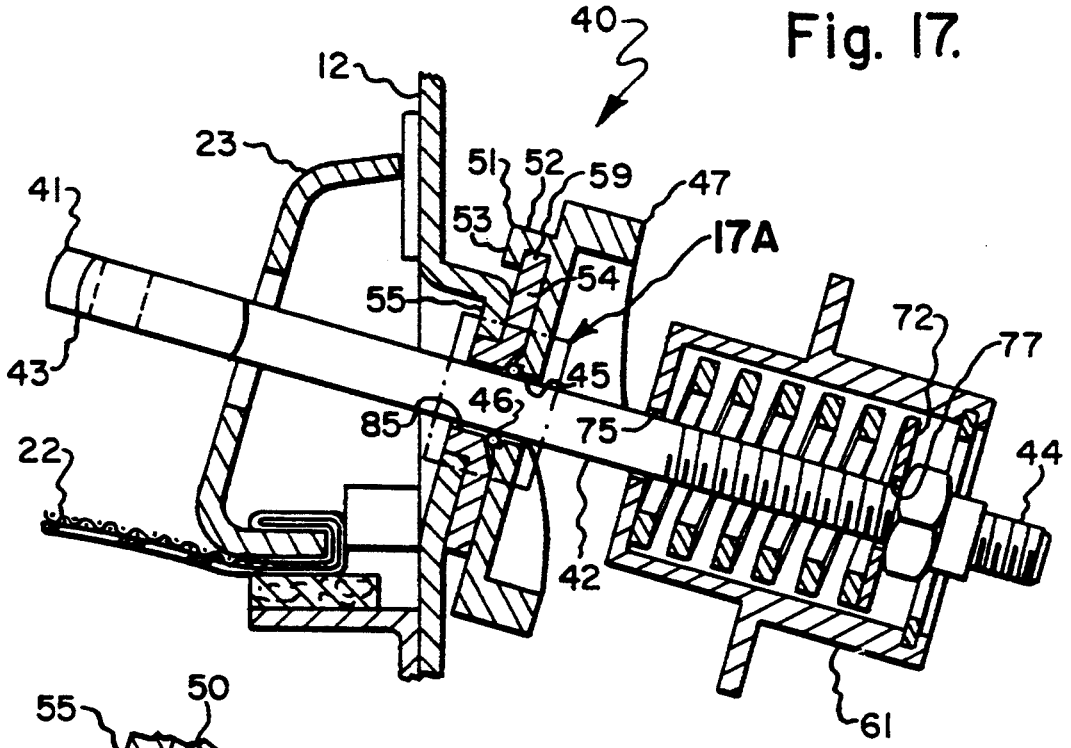
Fig. 17.
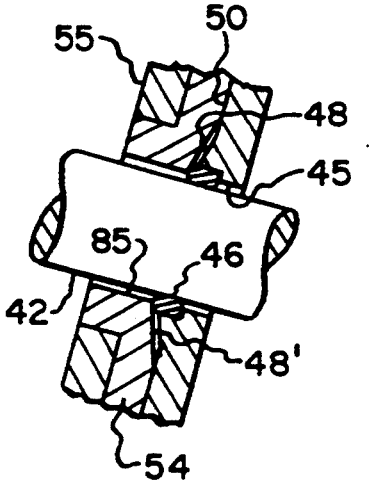
Fig. 17A.
Fig. 18.
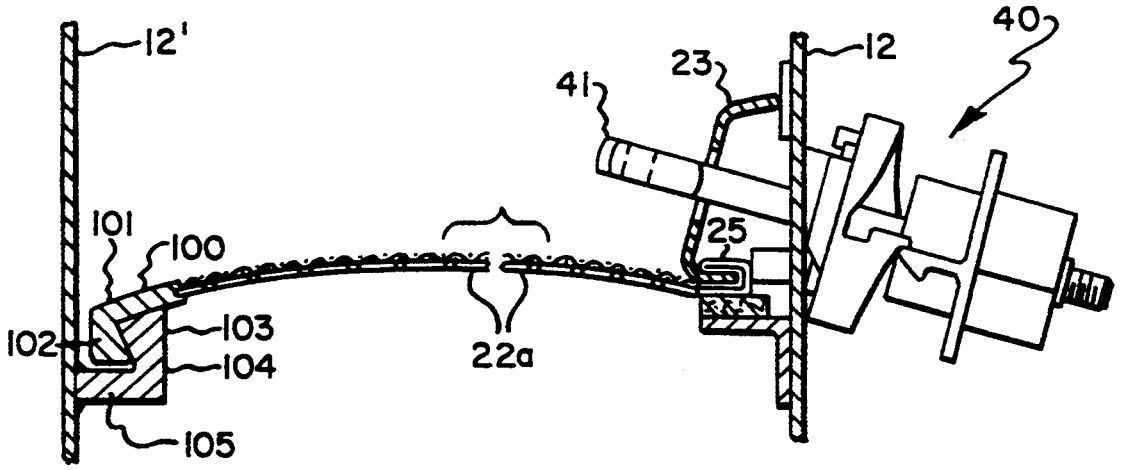

SCREEN ALIGNING, TENSIONING AND SEALING STRUCTURE FOR VIBRATORY SCREENING MACHINE

BACKGROUND OF THE INVENTION

The present invention relates to a vibratory screening machine having structure for aligning, sealing and installing the screens rapidly under proper tension.

By way of background, screens require replacement frequently in vibratory screening machines as the screens wear out. In the past, insofar as known, the screens were aligned by eye on the bed of the machine, and this frequently resulted in the screens being improperly located. Additionally, the seals which were used were solid resilient materials which became compressed during machine vibration and lost their sealing capacity. Also, the screens were tensioned by the use of drawbars which were tightened by means of a nut attached to draw bolts which engaged the drawbars. The deficiency of this type of arrangement was that there was no precise way, in the absence of using a torque wrench, for determining how much tensioning force was applied to the draw bolts. This oftentimes resulted in drawbars which were unequally tensioned at various points along their lengths and this caused uneven tension to be applied to the screens. In addition, on a machine having three screens there were usually twenty-four draw bolts. Each draw bolt was tightened by a nut which had to be turned numerous times during both the tightening and loosening procedure. This was extremely time-consuming. Since the flow of material to be screened could not be stopped during the changing of the screens, the longer the time required for changing the screens, the greater was the loss of material which could have been screened. This was particularly critical in the oil drilling industry where the loss of drilling mud which could have been reclaimed was directly proportional to the length of time required to change the screens.

SUMMARY OF THE INVENTION

It is accordingly one important object of the present invention to provide an improved quick release draw bolt device which can be used in conjunction with the drawbars utilized to tension a screen to thereby apply equal tensioning forces along the entire length of a draw bar in an extremely simple and expedient manner.

Another object of the present invention is to provide a quick release draw bolt device which can release a drawbar extremely rapidly and which can apply a measured predetermined amount of force to a draw bar in an extremely rapid manner.

A further object of the present invention is to provide a quick release draw bolt arrangement on a vibratory screening machine which permits a plurality of screens to be removed and a plurality of other screens to be remounted from the machine in an extremely rapid manner and under predetermined tensions.

A still further object of the present invention is to provide a draw bolt device which can accurately provide a precise determined amount of force every time it is tightened and which can both release such force and provide such force in an extremely rapid manner as a result of a simple manual manipulation.

Yet another object of the present invention is to provide an alignment structure for screens which are being mounted on a vibratory screening machine to thereby insure that the screens are located properly on the bed of the machine.

Still another object of the present invention is to provide an improved seal construction for sealing the edges of a vibratory screen to the bed of a vibratory screening machine and which will not become compressed to the point of permitting leakage as a result of machine vibration.

Yet another object of the present invention is to provide an improved screen for a vibratory screening machine having an aligning structure and an improved seal structure thereon. Other objects and attendant advantages of the present invention will readily be perceived hereafter.

The present invention relates to a quick release draw bolt device comprising a bolt member having first and second end portions and a central portion therebetween, first and second members mounted relative to said central portion of said bolt member, cam means and cam follower means effectively positioned between said first and second members for causing said first and second members to occupy relatively close and relatively remote positions with respect to each other, means on said first end portion of said bolt member for exerting a pulling force on an external member, and spring means mounted relative to said first and second members for causing said bolt means to exert said pulling force on said external member when said first and second members are in said relatively remote positions and for releasing said pulling force when said first and second members are in said relatively close positions.

The present invention also relates to an alignment structure for a screen of a vibratory screening machine comprising a vibratory screen, channel means on the end of said vibratory screen, a drawbar, flange means on said drawbar for entering said channel means, and interfitting means between said channel means and said flange means for aligning said channel means with said flange means.

The present invention also relates to a seal structure for a vibratory screen comprising a vibratory screen having opposite side edge portions, and a balloon-type of seal on at least one of said edge portions.

The present invention also relates to a screen for a vibratory screening machine comprising a screen body having end edge portions and side edge portions, channel means on said end edge portions for mounting said screen on a vibratory screening machine, alignment means on said channel means for aligning said channel means with a drawbar of a vibratory screening machine, and balloon seal means on at least one of said side edge portions for effecting a seal with said vibratory screening machine.

The present invention also relates to a screen for a vibratory screening machine comprising a screen body, screen means on said screen body, end edge portion means on said screen body for securing said screen body to a vibratory screening machine, and alignment means on said end edge portion means for aligning said screen body with the bed of a vibratory screening machine.

The present invention also relates to a vibratory screening machine comprising a frame, first and second side walls on said frame, a bed on said frame, a vibratory screen on said bed, first and second end edge portions on said vibratory screen located proximate said first and second side walls, respectively, first securing means for securing said first end edge portion relative to said first side wall, and second securing means comprising quick release tensioning means for operating between preset first and second positions to either secure said vibratory screen to said second wall with a predetermined tension when said quick release tensioning means is manipulated to said first position and to completely release said predetermined tension when said quick release tensioning means is manipulated to said second position.

The various aspects of the present invention will be more fully understood when the following portions of the specification are read in conjunction with the accompanying drawings wherein:

BRIEF DESCRIPTION OF THE DRAWINGS

FIG. 8 is a view similar to FIG. 7 and showing the next step in the calibration process wherein nut on the draw bolt has been advanced to compress the tensioning spring after the draw bar effectively bears against the side of the machine;

FIG. 10 is a view similar to FIG. 8 and showing the parts of the quick release draw bolt tensioner in a position for relieving the tension on the draw bar so that the screen can be removed from the screening machine;

FIG. 14 is a fragmentary cross sectional view with portions broken away taken substantially along line 14—14 of FIG. 15 and showing the various structural features of the bed of the machine, the screen and the drawbar;

FIG. 15 is a fragmentary cross sectional view taken substantially along line 15—15 of FIG. 14;

FIG. 17 is a fragmentary vertical cross sectional view showing the clearances between the various parts;

FIG. 17A is a fragmentary enlarged cross sectional view showing the seal between the bolt, the cam member and the side of the machine; and FIG. 18 is a fragmentary schematic view, partially in cross section, showing a modified embodiment of the present invention.

DESCRIPTION OF THE PREFERRED EMBODIMENTS

Figure 1:
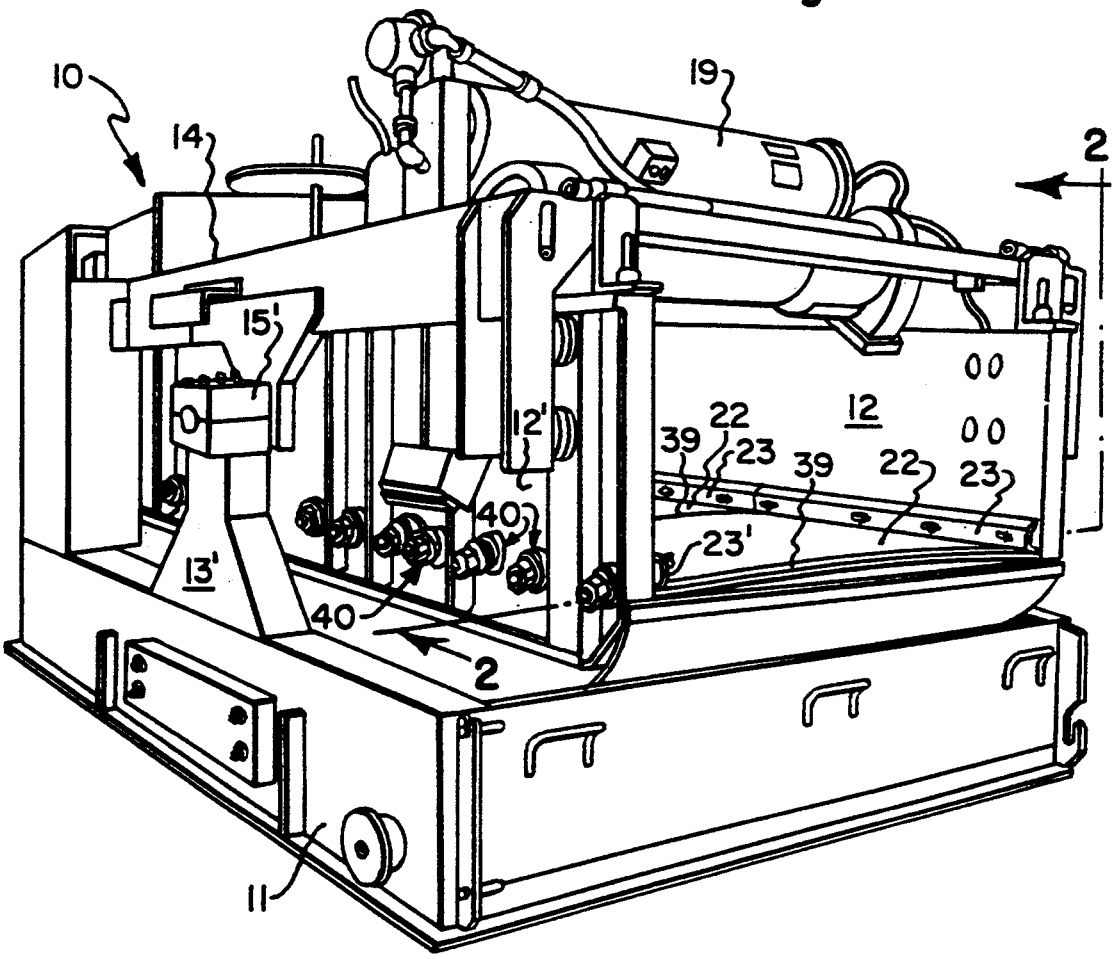
FIG. 1 is a perspective view of a vibratory screening machine mounting the improved screen aligning, tensioning and sealing structure of the present invention.
Figure 2:
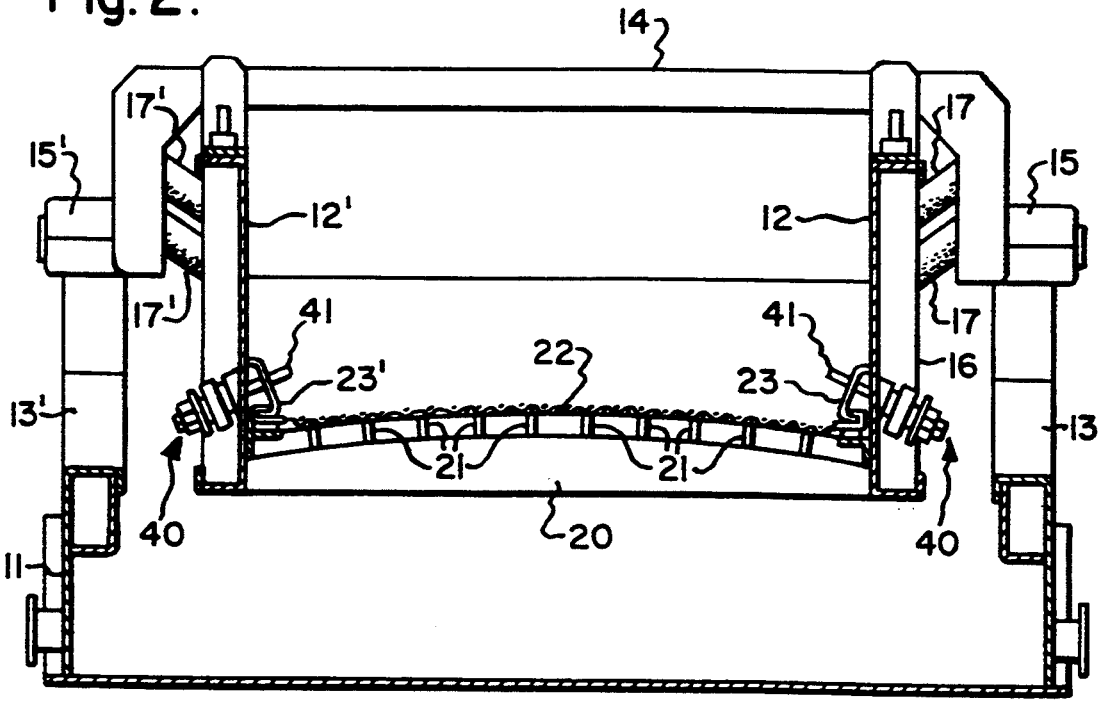
FIG. 2 is a cross sectional view taken substantially along line 2—2 of FIG. 1 and showing a vibratory screen in position on the bed of the machine and tensioned by the quick release draw bolt tensioners of the present invention.

The vibratory screening machine 10 is of conventional construction except for certain structure, namely, the quick release draw bolt tensioners associated therewith, the alignment structure for the screens, and the seals on the screens. A vibratory screening machine of the type shown in FIG. 1 is described in greater detail in U.S. Pat. No. 4,882,054, which is incorporated herein by reference, and therefore only the features of this machine which are relevant to the subject matter of the present invention will be described. In this respect, and summarizing in advance, the modifications to the existing machine comprise an alignment structure for properly aligning the replaceable screens of the machine relative to the draw bars which tension the screens; the seal arrangement between the screens and the supporting structure therefor on the machine; and the quick release draw bolt tensioning devices for applying proper tension to the screen in an extremely rapid and dependable manner and for relieving such tension rapidly to permit screen changes to be made in a fraction of the time which was required in previous constructions.

Insofar as pertinent here, the vibratory screening machine 10 includes a base 11 having a vibratory frame 14 suitably mounted thereon. Standards 13 and 13', which are mirror image counterparts, are mounted on base 11, and they pivotally support frame 14 by means of trunnions 15 and 15'. Side walls 12 and 12' are resiliently mounted on frame 14 by means of elastomeric connectors 17 and 17' to permit the screen supporting assembly 16 to vibrate when actuated by vibrator motor assembly 19 suitably connected thereto. In addition to struts (not shown) which connect walls 12 and 12' to each other, cross bars 20 are spacedly mounted between side walls 12 and 12' and suitably connected thereto, and elongated stringers 21 extend longitudinally of the machine and are connected between cross members 20. The stringers and cross members comprise the bed of the machine. In operation, the vibratory screen 22 rests on the bed of the machine which includes cross members 20 and plastic caps 18 mounted on stringers 21 as is well known in the art, as more specifically shown in U.S. Pat. No. 4,857,176, which, insofar as being pertinent here, is incorporated by reference. A fragmentary view of the bed of the machine is shown in FIG. 14.

Figure 13:
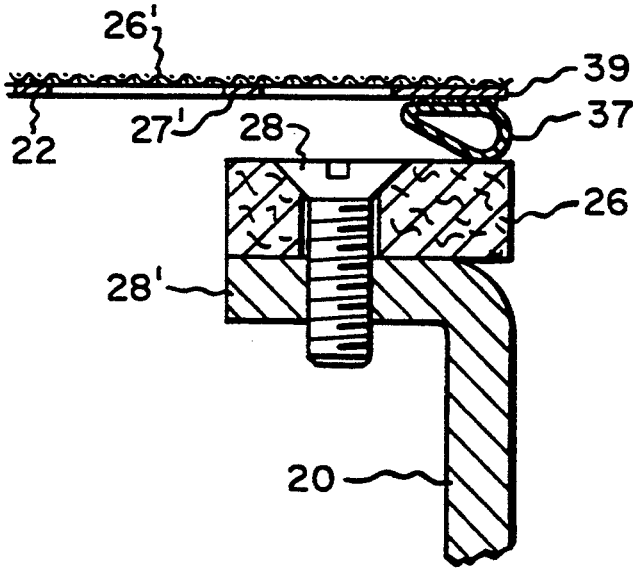
FIG. 13 is a fragmentary cross sectional view taken substantially along line 13—13 of FIG. 14 and showing the balloon seal affixed to the edge of the screen for sealing the edge of the screen to a rail on the bed of the machine, with the seal being shown in a non-compressed condition.

In accordance with one aspect of the present invention, structure is provided for causing the drawbars 23 and 23' to align each screen 22 perfectly on the bed of the machine so that it cannot cock or be misaligned relative to members 20. The alignment structure eliminates misalignment which may cause gaps between the edges 39 of the screen and strips 26 mounted on members 20 on which these edges bear (FIGS. 13 and 14). The machine 10, in this instance, has three screens 22 and three pairs of drawbars 23—23'. A pair of drawbars 23—23' is associated with each screen 22. Each pair of drawbars 23—23' is identical and therefore only one pair will be described. The alignment structure is very simple and consists of notches 24 and 24' (FIGS. 12 and 14) in channels 25 and 25' which are formed at the ends of screen 22. Screen 22 without such notches may be the type shown in U.S. Pat. No. 4,575,421 which is incorporated herein by reference. Broadly, screen 22 comprises a screen body 26' (FIGS. 7A and 12) including an apertured steel plate 27' having a plurality of screens 36 adhesively secured to its upper surface, with the ends of the plate being formed into channels 25 and 25'. The notches 24 and 24' receive upstanding tabs 29 and 29', respectively, which have been formed in drawbars 23 and 23', respectively. Thus, when the screen channels 25 and 25' are aligned with their associated drawbars 23 and 23', respectively, by the entry of tabs 29 and 29', respectively, into notches 24 and 24', respectively, the screen 22 is properly aligned with the cross members 20 of machine 10 because the drawbars 23 and 23' are properly positioned on the machine by their associated draw bolts. Also, when the tabs 29 and 29' enter cutouts 24 and 24', respectively, the flanges 30 and 30' of draw bars 23 and 23', respectively, are received in channels 25 and 25', respectively, of the screen 22 so that when draw bars 23 and 23', respectively, are drawn up, they will tension screen 22. It will be appreciated that the alignment structure can be used with any type of screen having channels at its ends, such as shown in U.S. Pat. No. 4,819,809 which is incorporated herein by reference, as well as with the above-mentioned U.S. Pat. No. 4,575,421.

Figure 13A:
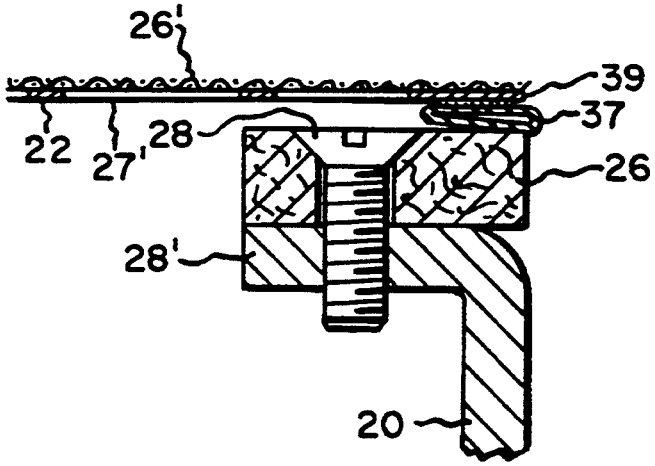
FIG. 13A is a view similar to FIG. 13 but showing the seal in a compressed condition after the screen has been tensioned.

In accordance with another aspect of the present invention, elastomeric balloon seals 37 (FIGS. 13, 13A and 14) are adhesively attached to the undersides of the longitudinal edges 39 of the screen, which may be of the type shown in U.S. Pat. No. 4,575,421, so that when they rest on elongated strips 26 which are secured to flanges 28' of cross members 20 (FIGS. 13 and 14) by means of screws 28, a good seal will be made therebetween so that there can be no leakage past the joint between edges 39 and elongated strips 26. Balloon seals 37 before being compressed have the cross sectional configuration of FIG. 13. It is to be noted that when screen 22 is tensioned from the condition of FIG. 13 to the condition of FIG. 13A, the balloon seal 37 will be compressed to provide good sealing. During vibration of the machine the seal 37 will flex to maintain good sealing. Stated otherwise, the seal will not become permanently compresssed in use, and thus it will retain its good sealing quality throughout the life of the screen. The seal 37 may be applied to the underside of the edges of any type of screen to which the seal can be adhesively attached. Thus, the alignment described above relative to FIG. 12 and the sealing structure described relative to FIG. 13 cooperate with each other to provide accurate positioning and sealing of the screen.

The quick release draw bolt tensioner aspect of the present invention serves a plurality of functions, as noted above. It always applies the identical uniform tension to the screens after the tensioners have been initially calibrated. The tensioners also permit the entire three screens to be replaced on the machine in a small fraction of the time which was previously required when utilizing simple nut assemblies such as the type shown in U.S. Pat. Nos. 4,857,176, 4,575,421 and 4,882,054. As can be seen from FIG. 1, four quick release draw bolt tensioners 40 are associated with each drawbar 23 and 23'. Draw bolt tensioners 40 will hereafter be referred to as tensioners rather than by their complete name, for the sake of clarity and brevity.

Figure 11:
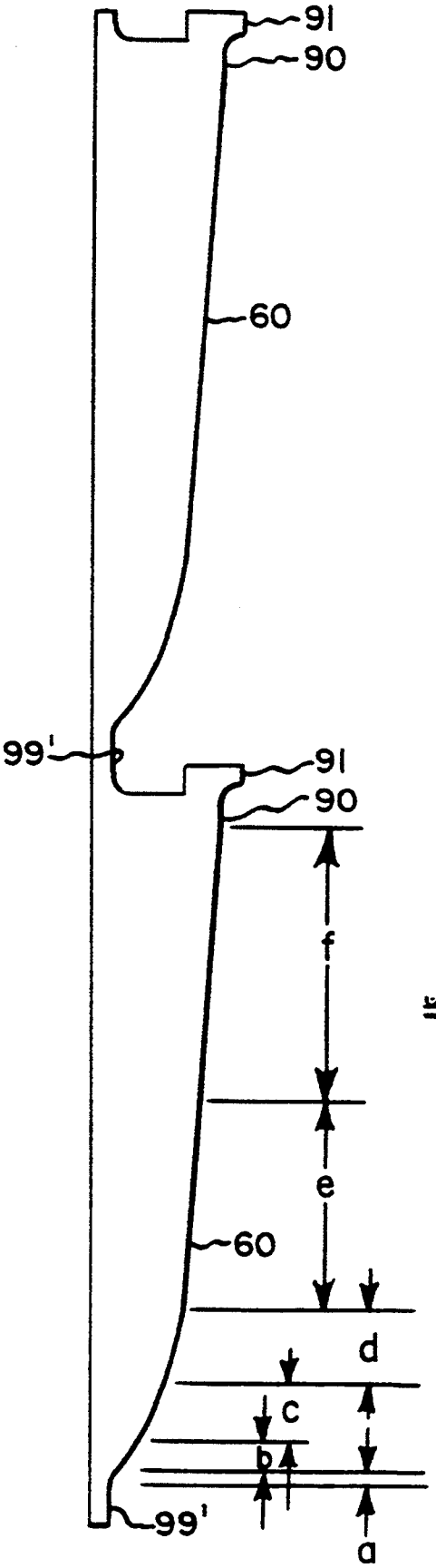
FIG. 11 is a layout showing the curvature of the ramp on the cam member of the tensioner.

The structure of each tensioner 40 is best shown in FIGS. 3, 4, 5 and 17. Each tensioner 40 includes a draw bolt 41 having a central portion 42, an enlarged head 43 at one end and a threaded portion 44 at its opposite end. The central portion of the draw bolt 41 is slidingly received in oversized aperture 45 in rear side 50 of cam member 47. Two parallel strips 49 (FIG. 4) are formed on the rear side 50. A leg 52 of an angle member 51 is formed on side 50. Leg 53 of angle member 51 extends downwardly. In use, strips 49 and angle 51 are utilized to mount cam member 47 on plate 54 (FIG. 5) welded to protrusion 55 which is formed in wall 12. Cam member 47 is mounted on plate 54 by sliding it downwardly on plate 54 so that strips 49 bracket edges 57 of plate 54 and the upper edge portion 59 of plate 54 is received by angle 51. The foregoing connection permits cam member 47 to be mounted and demounted easily from plate 54, if required. An O-ring sealing member 46 (FIGS. 5, 17 and 17A) fits between protrusion 48 (FIGS. 4 and 17A) in rear side 50 and depression 48' in plate 54 to provide a good seal between them and the central portion 42 of bolt 41 to prevent leakage of liquid which may enter aperture 85 in plate 54 from the portion of the machine where the screens are located. In this respect, it is to be noted that apertures 45 and 85 are of larger diameter than bolt 41 so that there is a clearance therebetween and seal 46 prevents leakage around bolt 41 notwithstanding such clearance. There is also clearance between bolt 41 and aperture 75 in member 61 and between bolt 41 and aperture 77 in movable wall 72. The clearance or looseness is necessary to permit proper play or interaction, without binding, among the various parts associated with bolt 41. Cam member 47 also includes two cam tracks 60, each of which encompasses 170° of the entire peripheral edge of member 47. A layout of cam tracks 60 is shown in FIG. 11. Cam tracks 60, and their relationship to other portions of tensioner 40 will be described hereafter at appropriate portions of the specification.

The tensioner 40 also includes a combined cam follower and spring carrying member 61 which is a casting. Cam follower member 61 includes a hollow cylindrical portion 62, the outer surface of which is received within wall portions 63 defined by the portions of cam member 47 on which cam tracks 60 are located when the parts are in their closest position of FIG. 10, which is described hereafter. Cam follower member 61 also includes a fixed rear wall 64 at the end of cylindrical portion 62 which defines one side of a cavity 65 in which helical spring 67 is located. The sides of cavity 65 are defined by the internal surface of cylindrical portion 62 and the internal surface 69 of housing portion 70 which has an hexagonal outer surface 71 for receiving a wrench. A rim 68 is located between cylindrical portion 62 and housing portion 70. A movable wall in the form of a washer-like member 72 defines the end of cavity 65 opposite fixed wall 64. Washer-like member 72 is retained within housing portion 70 by a snap ring 73 which is received in a groove 74 in housing portion 70. Spring 67 bears on end wall 64 and on washer-like member 72. End wall 64 has an oversized aperture 75 therein, and movable end wall 72 has an oversized aperture 77 therein. The central portion 42 of bolt 41 is movably received in apertures 75 and 77 and it passes through spring 67. A pair of cam follower members 79 are formed integrally with rim 68 and cylindrical portion 62, and their outer ends are in a position to follow cam tracks 60 when the opening 80 of a wrench such as 81 is applied to outer surface 71 of housing 70 to turn it. A nut 82 threads onto the threaded end 44 of draw bolt 41, and it has a gripping extension 83 thereon which causes the nut to remain fixed in the position on thread 44 to which it has been turned by the open end 84 of wrench 81.

Figure 5A:
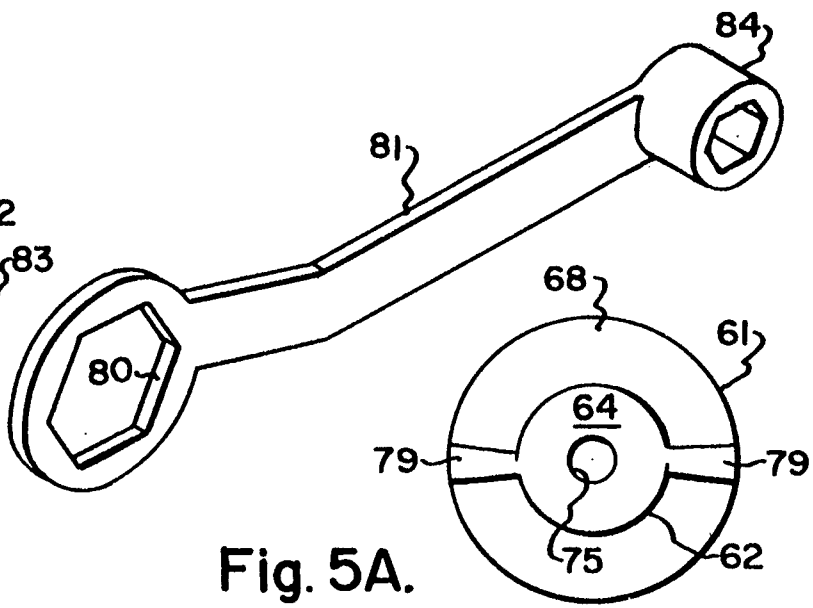
FIG. 5A is a view taken substantially in the direction of arrows 5A—5A of FIG. 5 and showing the end of the cam follower of the draw bolt tensioner.
Figure 5:
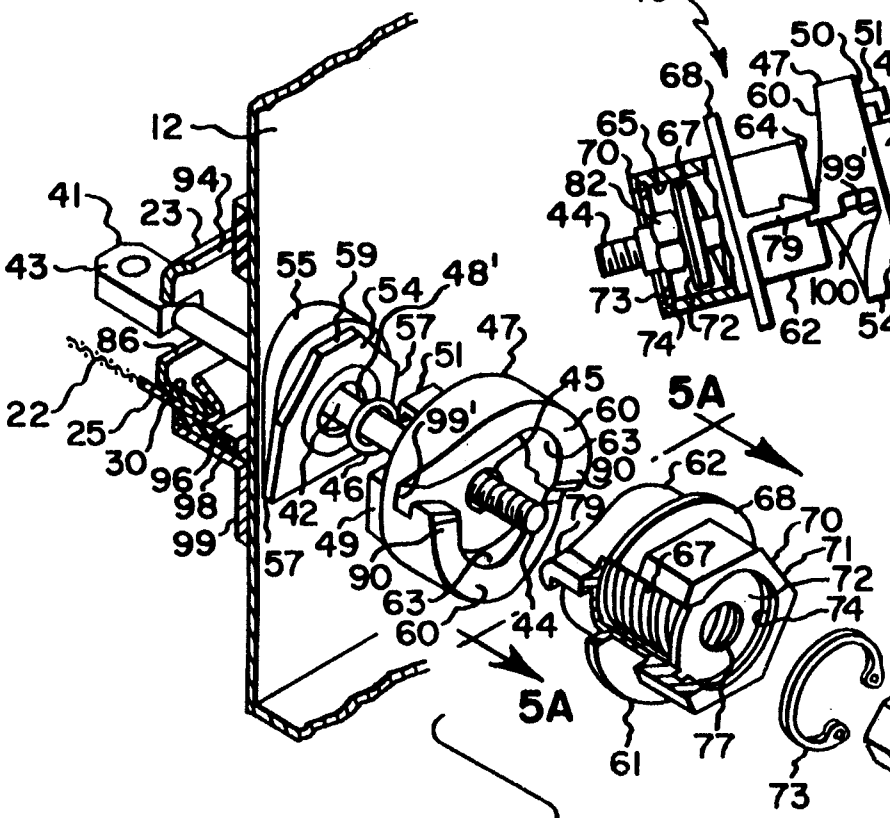
FIG. 5 is a fragmentary exploded view showing the quick release draw bolt tensioner associated with a draw bar which is positioned proximate the side wall of the vibratory screening machine and which engages a channel on the edge of the vibratory screen.
Figure 6:
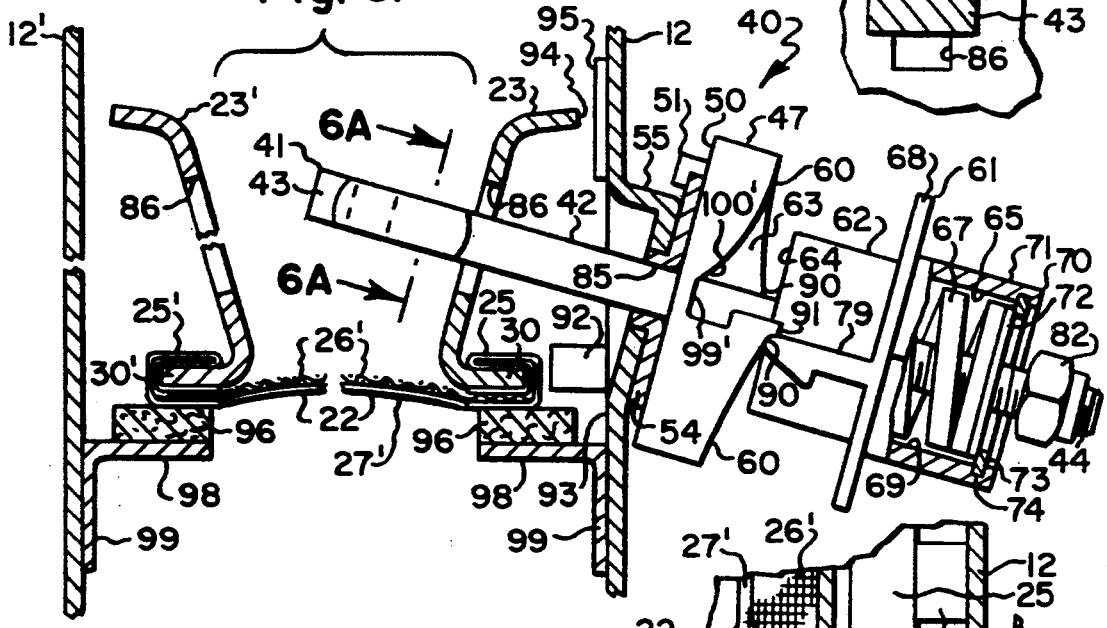
FIG. 6 is an enlarged fragmentary view, partially in cross section, also taken substantially along line 2—2 of FIG. 1 and showing the relative positions of the parts of the quick release draw bolt tensioner, the draw bar, the edge of the vibratory screen, and the side of the vibratory screening machine when the draw bolt tensioner is initially being mounted on the machine and before the tensioner is calibrated for quick-release and quick tightening action.
Figure 6A:
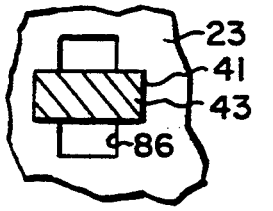
FIG. 6A is a fragmentary cross sectional view taken substantially along line 6A—6A of FIG. 6 and showing the manner in which the end of the draw bolt engages the draw bar.

In FIGS. 6–10 the manner in which each tensioner 40 is utilized is described. FIGS. 6–10 are primarily schematic and are not drawn entirely to scale and have parts omitted. Initially, as can be visualized from FIG. 5, the draw bolt 41 with nut 82 removed is inserted through aperture 85 (FIG. 6) in plate 54, O-ring 46, aperture 45 in cam member 47, aperture 75 (FIG. 5A) in fixed wall 64 of cam follower member 61 and aperture 77 in movable wall 72. Thereafter, nut 82 is threaded onto threaded end 44 of bolt 41. At this time cam follower member 47 is mounted on plate 54. The same procedure is followed for all of the twenty-four tensioners mounted on screening machine 10. At this time nut 82 on threaded end 44 is spaced from movable end wall 72 on cam follower 61, as shown in FIG. 6. Thereafter, the end 43 of each draw bolt 41 is rotated so that it fits through each opening 86 in drawbar 23 and thereafter it is turned to assume the position shown in FIG. 6A. This same procedure is followed relative to the three drawbars 23 and the three drawbars 23' on the opposite side of the machine. Each drawbar has four tensioners associated therewith.

After the foregoing procedure has been effected with a pair of opposed drawbars 23 and 23', a screen 22 is installed in the position of FIG. 6 by inserting flanges 30 and 30' of the drawbars into channels 25 and 25', respectively, until tabs 29 and 29' are aligned with notches 24 and 24', respectively, thereby aligning the screen 22 with its associated drawbars 23 and 23'. See FIG. 12. At this time channels 25 and 25' will rest on strips 96 (FIGS. 12, 14 and 15) which are secured by screws 97 (FIG. 14) to legs 98 of angles 99 which are welded to the sides 12 and 12' of the machine. This procedure is followed with each of the three screens 22 on the machine.

After the foregoing has been effected, each of the four tensioners 40 associated with each drawbar 23 is adjusted so that the cam followers 79 are located on the high points 90 of cam tracks 60 against stops 91 (FIG. 6). In this position, end wall 64 of cam follower member 61 is spaced its maximum distance away from cam member 47. Nut 82 is then tightened to draw drawbar 23 to the right to the position of FIG. 7 from its position of FIG. 6 until channel 25 (FIG. 6A) bears against stop blocks 92 (FIGS. 7, 7A and 14) which are welded to the surface 93 of side wall 12. There is one pair of stop blocks 92 associated with each tensioner 40. At this time the upper edge 94 of drawbar 23 will bear against plate 95 welded to side wall 12. As noted above, the nut 82 is tightened until drawbar 23 reaches the above-described position, but at this time movable wall 72 of cam follower member 61 has not been moved inwardly into cavity 65 against the bias of spring 67. This procedure is followed with all twelve of the tensioners 40 associated with machine wall 12 on which blocks 92 are mounted.

The next step in the calibration process is depicted in FIG. 8 wherein nut 82 is tightened onto threaded end portion 44 to move movable wall 72 into cavity 65 against the bias of spring 67. The spring 67 has a predetermined spring rate, for example, 300 pounds per $\frac{1}{8}$ inch. Therefore, if the nut is tightened so that movable end wall 72 moves $\frac{3}{8}$ of an inch from its position of FIG. 7 to its position of FIG. 8, spring 67 will exert a force of 900 pounds biasing draw bolt 41 against drawbar 23, and this is the force exerted by channel 25 against blocks 92. This procedure is followed with each of the tensioners 40 associated with machine side 12. Therefore at this time each of the three drawbars 23 is biased against stops 92 by its associated tensioner 40.

Figure 9:
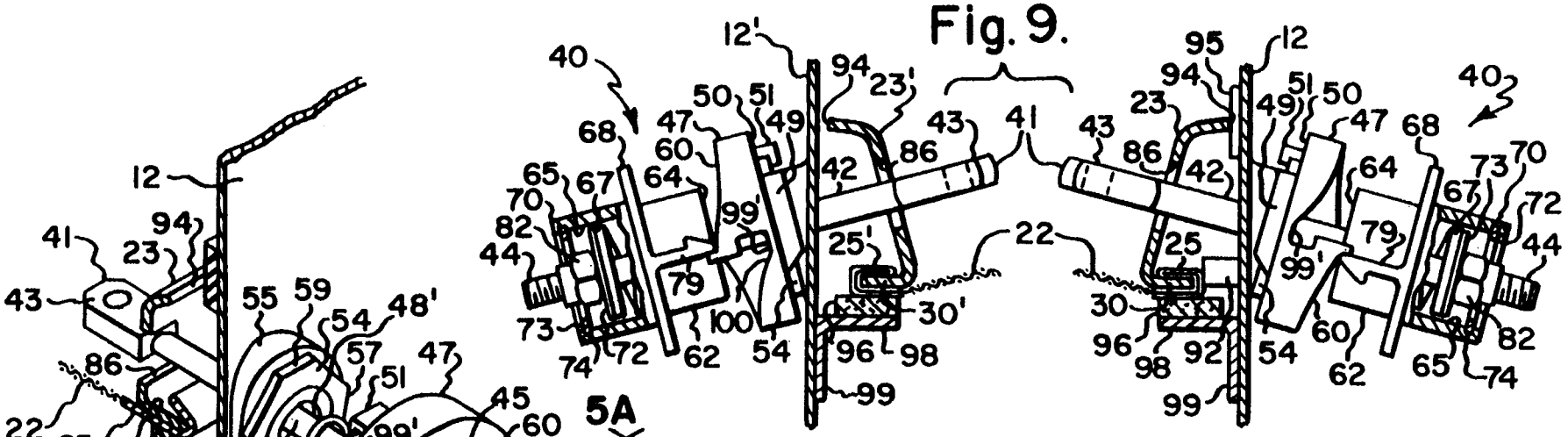
FIG. 9 is a reduced fragmentary cross sectional view showing the tensioners on opposite sides of the machine in the positions in which they fully tension the screen.
Figure 7:
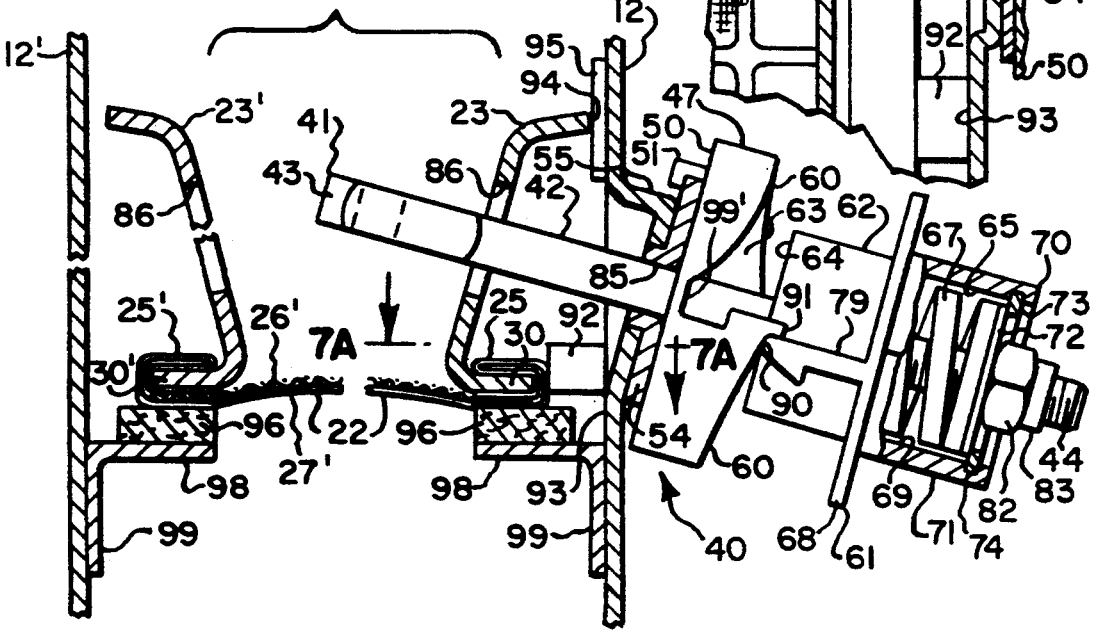
FIG. 7 is a fragmentary cross sectional view similar to FIG. 6 and showing the first step in calibrating the quick release draw bolt tensioner.
Figure 7A:
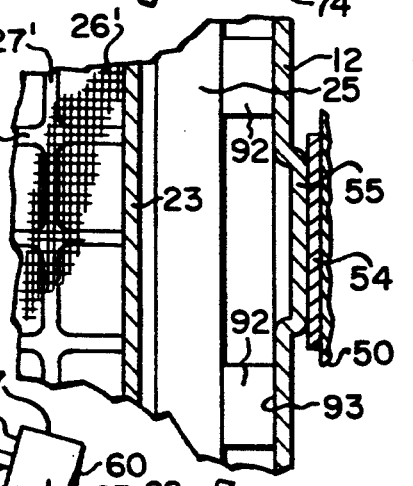
FIG. 7A is a fragmentary cross sectional view taken substantially along line 7A—7A of FIG. 7 and showing the relationship between the edge of the screen and the side of the vibratory screening machine when the parts are in the position of FIG. 7.

The same procedure described above is then followed with each of the tensioners 40 associated with the opposite wall 12'. In this respect, each nut 82 is brought up to a position such as shown in FIG. 7 wherein it bears against movable wall 72 and head 43 of each draw bolt 41 bears against its associated drawbar 23' and the screen 22 is taut but not under appreciable tension. Thereafter, each tensioner 40 associated with wall 12' is tightened to the condition shown in FIG. 8 wherein each spring therein is compressed by moving wall 72 inwardly the same amount as shown relative to wall 72 in FIG. 8. Therefore, each of the three drawbars 23' associated with wall 12' will have four tensioners 40 each exerting a spring force of 900 pounds thereon. At this time, the channel 25 of each screen is still located against stops 92 because the tensioning of tensioners 40 associated with each drawbar 23' the same amount as applied to tensioners 40 associated with drawbars 23 will not move in channels 25 away from stops 92. This condition is shown in FIG. 9. Furthermore, if for any reason the tension applied by tensioners 40 associated with drawbar 23' is slightly greater than the forces applied by tensioners 40 associated with drawbar 23, the screen will still probably not move to the left because of the frictional engagement of the screen with strips 26 on cross members 20 and caps 18 on stringers 21. The net effect is that whenever all of the tensioners 40 are in the positions of FIG. 8, the screens 22 will be held in their operating condition for effecting screening operations, and the biasing force on each screen will be 900 pounds. During machine operation, the tensioners 40 and the screen 22 are in the positions of FIG. 9.

Figure 3:
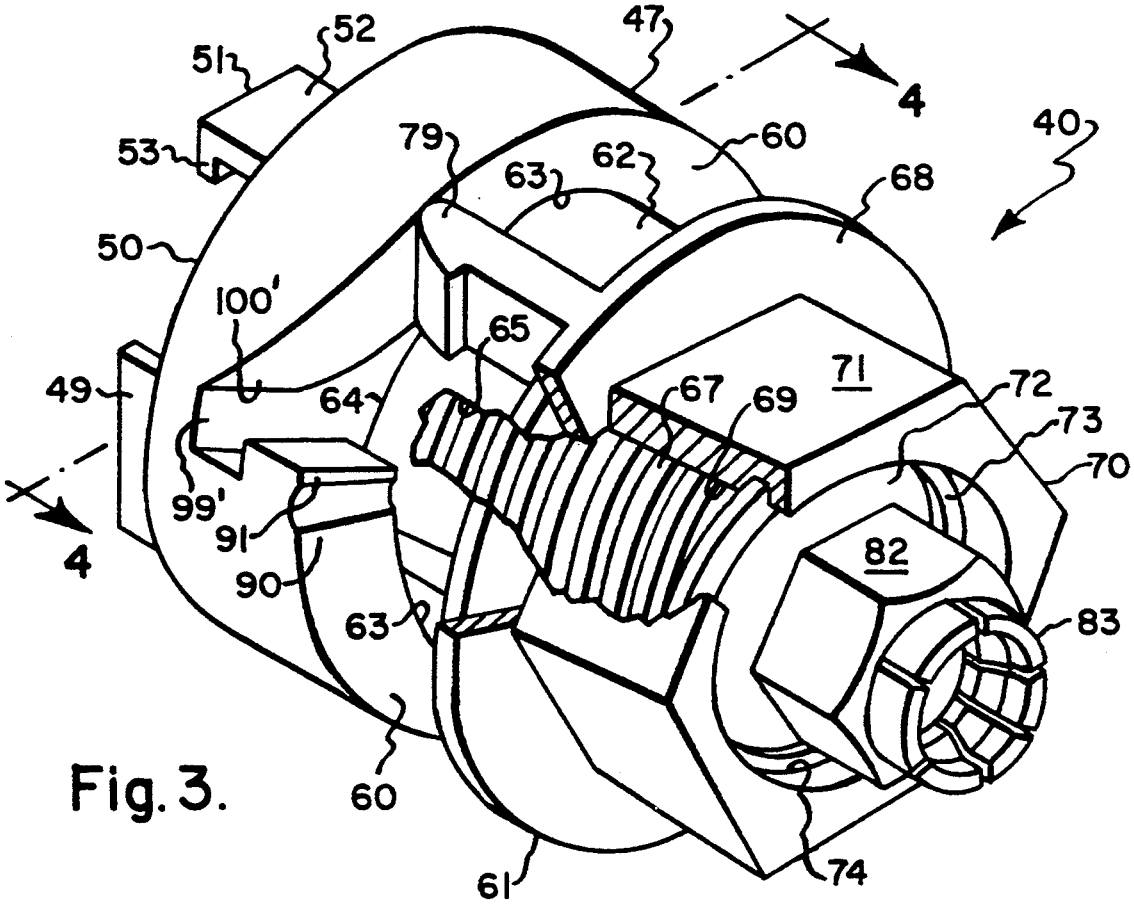
FIG. 3 is perspective view, partially broken away, showing the quick release draw bolt tensioner of the present invention with the draw bolt removed.
Figure 4:
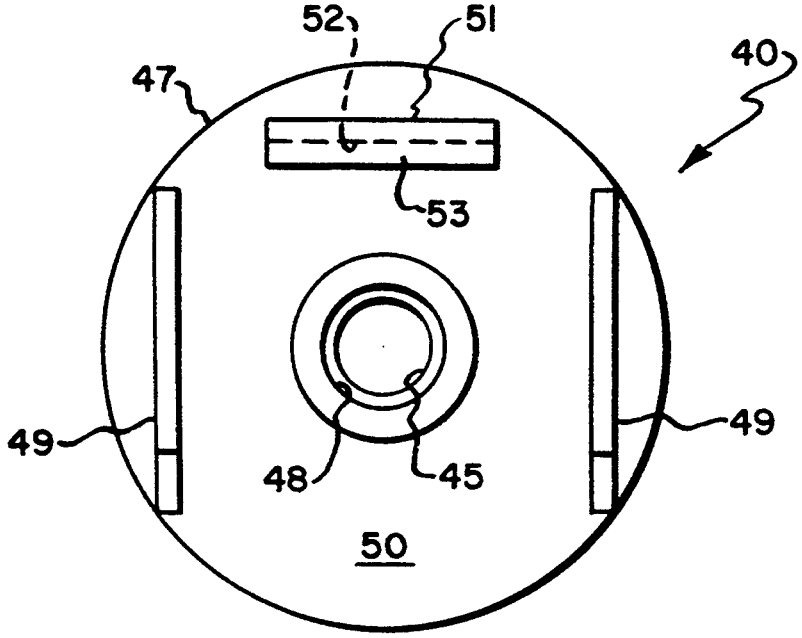
FIG. 4 is a view taken substantially in the direction of arrows 4—4 of FIG. 3 and showing the rear of the tensioner of FIG. 3.

When it is desired to remove each screen 22 from the machine for replacement, all that is necessary is to apply the end 80 of wrench 81 to each housing 70 of each tensioner 40 associated with a drawbar 23' at machine wall 12' and turn it in a counterclockwise direction in FIGS. 3 and 5 so that cam followers 79 move from the high points 90 of cam tracks 60 to points 99' adjacent the lowermost portions 100' of cam tracks 60. Cam follower member 61 will therefore be in the position of FIG. 10 relative to cam member 47. While this is illustrated relative to wall 12 in FIG. 10, it is stressed that all of the tensioners 40 associated with a drawbar 23' are loosened first. When this loosening occurs, spring 67 will expand from its condition of FIG. 8 to its condition of FIG. 10 and move movable wall 72 back to the position of FIG. 10 from the position of FIG. 8. Also, at this time the length of draw bolt 41 can be extended into the space within walls 12 and 12' because the amount that cam follower member 61 moves toward cam member 47 from the position of FIG. 8 to the position of FIG. 10 is greater than the amount that movable wall 72 moves from the position of FIG. 8 to the position of FIG. 10. However, since cam member 47 is affixed to its associated wall 12', the length of draw bolt 41 which can be spaced inwardly of wall 12' can increase, and this can be seen from a comparison of FIGS. 8 and 10. After the foregoing loosening is effected with each tensioner associated with each channel member 23', the foregoing manipulation or loosening is then effected with each of the tensioners 40 associated with drawbars 23 mounted on wall 12.

It is to be again especially noted that the tensioners 40 associated with wall 12' and a drawbar 23' are manipulated to the condition of FIG. 10 prior to the time that the tensioners 40 associated with wall 12 and a drawbar 23 are manipulated to the condition of FIG. 10. This is for the reason that it is desired to relieve the tensioning force on channel 25' associated with drawbar 23' before relieving the force on channel 25 associated with drawbar 23 because as the tensioning force is relieved on channel 25', channel 25 will remain in position against stops 92, or if it has previously been moved to the left from stops 92, it will move up against stops 92. However, there are not such stops associated with wall 12', and therefore if the tension on drawbar 23 was relieved first, the channels 25' would move into engagement with wall 12', which is not desired.

After all of the tensioners 40 have been adjusted to the condition of FIG. 10, a screen 22 can be disengaged from drawbars 23 and 23' because drawbars 23 and 23' can be moved sufficient distances away from walls 12 and 12', respectively, to permit them to be disengaged from channels 25 and 25', respectively. After the screens 22 have been removed, the new screens 22 can be installed by inserting the flanges 30 and 30' into their channels 25 and 25', respectively, in aligned relationship as determined by the coaction of tabs 29 and 29' with slots 24 and 24', respectively. Thereafter, all that is necessary is to apply the end 80 of wrench 81 to nut portion 70 of each cam follower member 61 adjacent machine side 12 and rotate it 170° in a clockwise direction in FIGS. 5 and 3 so as to cause cam follower 79 to ride up along cam tracks 60 and thus cause cam follower member 61 to move away from cam member 47 to its position of FIG. 8. This will result in the automatic compressing of springs 67 the required amount in each of the tensioners 40 as movable wall 72 is caused to move into cavity 65 by the action of nut 82 thereon as cam member 41 and cam follower member 61 are caused to move apart.

It is to be especially noted that once nuts 82 have been adjusted initially to the position of FIG. 8 in the above-described manner, there is never any need to adjust them again because when the members 47 and 61 are moved apart to the position of FIG. 8 from the position of FIG. 10, the amount that spring 67 in each tensioner 40 will be compressed by the movement of wall 72 into member 61 will always be the same. It is to be especially noted that during the tightening procedure, tensioners associated with side 12 are manipulated from the condition of FIG. 10 to the condition of FIG. 8 before the tensioners 40 associated with side 12' are moved to the condition of FIG. 8, as described above.

In FIG. 11 the slope of cam surfaces 60 is shown. This slope changes throughout the length of the cam track. More specifically, the slope is relatively steep at length a and is less steep for length b and is still less steep for length c and is less steep for length d. It is still less steep for length e and still less steep for length f. The practical significance of the changing steepness of cam track 60 is that more length of rotary travel of member 61 is required as the compression of spring 67 progresses. This means that the force required to turn member 61 by means of wrench 81 will remain constant throughout the entire 170° of its travel. Essentially, the cam track operates in the manner of an inclined plane wherein the more each spring is compressed, the more gradual is the slope of the cam to thus require less work to compress it because the force which is applied acts through a greater distance. In actual use, a uniform force of eight pounds was required throughout the entire 170° travel of the cam follower member.

As noted above, the use of the alignment structure results in the aligning of the screens with the drawbars in a simple and expedient manner. In addition, the use of tensioners 40 permits the three screens 22 to be changed in a small fraction of the time that was previously required with conventional assemblies. In this respect, it previously took approximately 8 minutes to change the screens with structures such as shown in FIG. 17 of U.S. Pat. No. 4,882,054. However, with the tensioners 40 of the present invention, three screens 22 using a total of twenty-four tensioners 40 can be changed in approximately 1 minute. In this respect, as noted above, after each tensioner 40 has been initially calibrated, it is only required that each housing 70 be turned 170° to tighten each tensioner 40 as compared to the requirement for turning the nuts of previous tensioning arrangements numerous times. The advantage of this is that there is much shorter down time which is especially important in screening machines utilized in the oil drilling industries to reclaim drilling mud because when the screening machine is down, the liquid containing the drilling mud has to be dumped rather than screened to reclaim the mud.

In FIG. 18 a further embodiment of the present invention is disclosed. In this embodiment tensioners 40 are associated with only side 12 of the machine and not with side 12'. In this respect, the screen **22*a* has an end in the form of a hooking strip 100 which extends the width of the screen. The hooking strip is in the shape of an L having a portion 101 which is suitably fastened to end edge of the screen, and it has a downwardly extending leg 102 which forms a hooking member. Leg 102 engages the upstanding leg 103 of locking bar 104 which has a horizontal leg 105 welded to machine side 12'. In use, when tensioner 40 is in the loosened condition of FIG. 10, the hooking strip 100 is placed in the position shown in FIG. 18, and thereafter the drawbar 23 is placed in engagement with channel 25 of the screen. Thereafter, the tensioner is manipulated to the condition of FIG. 8. To remove the screen 22***a*, all that is necessary is to manipulate the tensioner 40 to the condition of FIG. 10 from the condition of FIG. 8, which will thus relieve the pulling force on bolt 41 to in turn permit it to be moved the position of FIG. 10, whereupon the screen 22*a* will be sufficiently loose so that channel 25 can be disengaged from drawbar 23 and hooking strip 100 can be disengaged from locking bar 104. A new screen can then be installed by placing the hooking strip 100 into the position of FIG. 18 and placing the drawbar 23 into the channel 25 and thereafter manipulating the tensioner 40 to the condition of FIG. 8.

Figure 12:
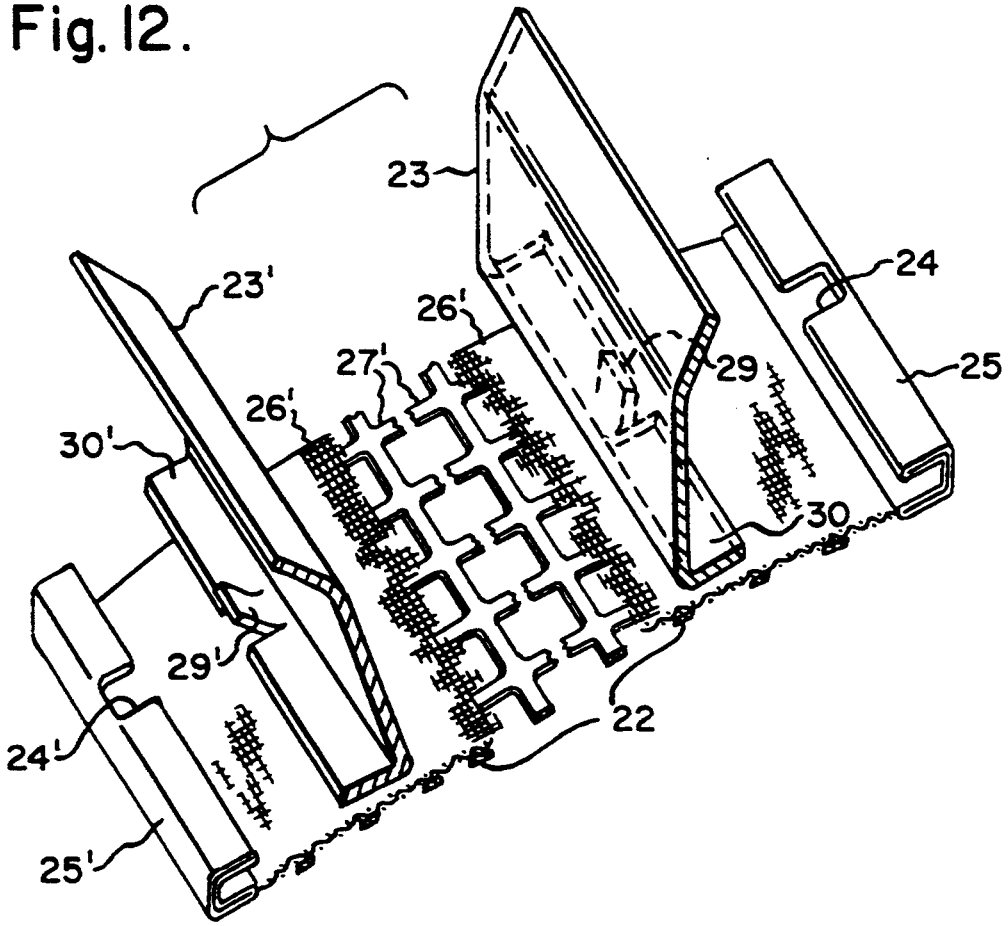
FIG. 12 is a fragmentary perspective view showing the cooperating structure of the drawbars and the channel edges of the screen for effecting precise alignment therebetween on the bed of the machine.
Figure 16:
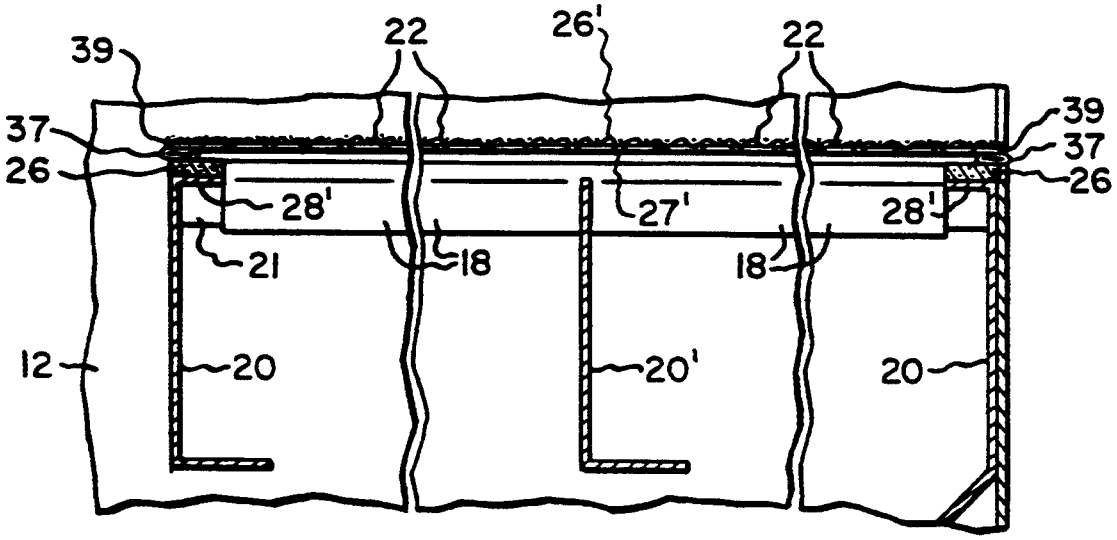
FIG. 16 is a fragmentary cross sectional view taken substantially along line 16—16 of FIG. 14 and showing the structure of the machine bed which supports the screen.

While a specialized type of screen 22*a* having a hooking strip 100 has been disclosed, it will be appreciated that a screen of the type shown in FIG. 12 having channels, such as 25 and 25', on opposite end edges thereof can also be used in an installation wherein only one set of tensioners 40 is utilized on one side of the machine, as shown in FIG. 18. In this respect, a drawbar, such as 23' of FIG. 12, can be securely and immovably fastened to machine side 12', and channel 25' can be engaged with drawbar 23', and thereafter channel 25 can be engaged with drawbar 23 while the tensioner 40 was in the condition of FIG. 10, and thereafter the tensioner can be manipulated to the condition of FIG. 8 to apply the proper tension to the screen.

It is also to be noted that in an embodiment such as shown in FIG. 18, an aligning mechanism consisting of a notch 24 in channel 25 and a tab 29 in channel 23 (FIG. 12) can be used to effect proper alignment of a screen such as 22*a* with the bed of the machine. The opposite end edge of the screen 22*a* having the hooking strip 100 thereon must then be in proper alignment when the notch 24 and tab 29 are in engagement. Also, in the embodiment of FIG. 18 sealing strips, such as 37 (FIG. 13), can also be used.

While preferred embodiments of the present invention have been disclosed, it will be appreciated that it is not limited thereto but may be otherwise embodied within the scope of the following claims.

What is claimed is:

1. A quick release draw bolt device comprising a bolt member having first and second end portions and a central portion therebetween, first and second members mounted on said central portion of said bolt member, cam means and cam follower means effectively positioned between said first and second members for causing said first and second members to occupy relatively close and relatively remote positions with respect to each other, means on said first end portion of said bolt member for exerting a pulling force on an external member, and spring means mounted relative to said first and second members for causing said bolt means to exert said pulling force on said external member when said first and second members are in said relatively remote position and for releasing said pulling force when said first and second members are in said relatively close position.

2. A quick release draw bolt device as set forth in claim 1 including means for mounting said first member on a second external member which is located between said first member and said external member.

3. A quick release draw bolt device as set forth in claim 2 wherein said spring means is mounted on said second member.

4. A quick release draw bolt device as set forth in claim 3 wherein said spring means is mounted within a cavity in said second member.

5. A quick release draw bolt device as set forth in claim 4 wherein said cavity is bounded by a fixed wall on said second member proximate said first member, and a movable wall on the opposite side of said spring means from said fixed wall.

6. A quick release draw bolt device as set forth in claim 5 including means on said second end portion of said bolt member for engaging said movable wall and causing said movable wall to effect a predetermined amount of compression of said spring means when said first and second members are in said relatively remote position.

7. A quick release draw bolt device as set forth in claim 1 wherein said cam means has first and second ends and is of varying inclination including a portion of relatively steep slope at said first end which becomes less steep as said cam means progresses toward said second end, and wherein said cam follower means is located proximate said first end of said cam means when said first and second members occupy said relatively close position and wherein said first and second members occupy said relatively remote position when said cam follower means is located proximate said second end.

8. A quick release draw bolt device as set forth in claim 7 including means for mounting said first member on a second external member which is located between said first member and said external member.

9. A quick release draw bolt device comprising a bolt member having first and second end portions and a central portion therebetween, first and second members, an aperture in said first member for movably receiving said central portion of said bolt member, means on said first member for engaging an external member in abutting relationship, a cavity in said second member, a fixed end wall in said second member adjacent said first member defining a first wall of said cavity, a movable end wall in said second member spaced from said fixed wall, apertures in said fixed and movable end walls for movably receiving said central portion of said bolt member, a spring in said cavity between said fixed end wall and said movable end wall in encircling relationship to said central portion of said bolt member, means on said first end portion of said bolt member for engaging a member to be tensioned, a thread on said second end portion of said bolt member, a nut mounted on said threaded end portion of said bolt member for engaging said movable end wall to selectively effect an initial compression of said spring when said nut is tightened, coacting cam means and follower means between said first and second members for permitting said first and second members to assume a first relatively close position wherein said spring is permitted to expand from a compressed condition by permitting said movable end wall to move to an away position from said fixed end wall and for causing said first and second members to assume a second relatively spaced apart position wherein said nut forces said movable end wall toward said fixed end wall to compress said spring therebetween, and turning means for turning said second member relative to said first member to move said first and second members between said first and second positions.

10. A quick release draw bolt device as set forth in claim 9 wherein said cam means is of shallower inclination as said follower means travels along said cam means in a direction to cause said second member to assume said relatively spaced apart position.

11. A vibratory screening machine comprising a frame, side walls on said frame, a bed on said frame, a vibratory screen, end edge portions on said screen, channel means on said end edge portions, drawbar means located proximate the junction of said bed and said side walls for engaging said vibratory screen, flange means on said drawbar for entering said channel means, and interfitting means between said channel means and said flange means for aligning said channel means with said flange means for aligning said channel means with said flange means in a direction longitudinally thereof, quick release draw bolt means coupling said side walls and said drawbar means, each of said draw bolt means comprising a bolt member having first and second end portions and a central portion therebetween, first and second members mounted relative to said central portion of said bolt member, cam means and cam follower means effectively positioned between said first and second members for causing said first and second members to occupy relatively close and relatively remote positions with respect to each other, means on said first end portion of said bolt member for exerting a pulling force on said drawbar, and spring means mounted relative to said first and second members for causing said bolt means to exert said pulling force on said drawbar when said first and second members are in said relatively remote position and for releasing said pulling force when said first and second members are in said relatively close position.

12. A vibratory screening machine as set forth in claim 11 wherein said interfitting means comprises cooperating tab means and notch means.

13. A vibratory screening machine as set forth in claim 12 wherein said tab means is located on said flange means, and wherein said notch means is located on said channel means.

14. A vibratory screening machine as set forth in claim 12 wherein said interfitting means are located on both of said end edge portions.

15. A vibratory screening machine as set forth in claim 11 including opposed side edge portions on said vibratory screen, and a balloon-type seal on at least one of said side edge portions.

16. A vibratory screening machine as set forth in claim 15 wherein said balloon-type seal is on both of said side edge portions.

17. A vibratory screening machine comprising a frame, first and second side walls on said frame, a bed on said frame, a vibratory screen, first and second end edge portions on said screen, channel means on said first end edge portion, drawbar means located at the junction of said bed and said first side wall for exerting a pulling force on said channel means, flange means on said drawbar means for entering said channel means, securing means for securing said second end edge portion to said second side wall, and quick release draw bolt means coupling at least said first side wall and said first drawbar means, said draw bolt means comprising a bolt member having first and second end portions and a central portion therebetween, first and second members mounted on said central portion of said bolt member, cam means and cam follower means effectively positioned between said first and second members for causing said first and second members to occupy relatively close and relatively remote positions with respect to each other, means on said first end portion of said bolt member for exerting a pulling force on said drawbar, and spring means mounted relative to said first and second members for causing said bolt means to exert said pulling force on said drawbar when said first and second members are in said relatively remote position and for releasing said pulling force when said first and second members are in said relatively close position.

18. A vibratory screening machine as set forth in claim 17 including second channel means on said second edge portion of said vibratory screen, and wherein said securing means comprise second flange means secured to said second side wall for entering said second channel means.

19. A vibratory screening machine as set forth in claim 18 wherein said second flange means are fixedly secured to said second side wall.

20. A vibratory screening machine comprising a frame, first and second side walls on said frame, a bed on said frame, a vibratory screen on said bed, first and second end edge portions on said vibratory screen located proximate said first and second side walls, respectively, first securing means for securing said first end edge portion relative to said first side wall, and second securing means comprising quick release tensioning means for securing said second end edge portion relative to said second side wall, said second securing means comprising a bolt member having first and second end portions and a central portion therebetween, first and second members mounted on to said central portion of said bolt member, cam means and cam follower means effectively positioned between said first and second members for causing said first and second members to occupy relatively close and relatively remote positions with respect to each other, means on said first end portion of said bolt member for exerting a pulling force on said second end edge portion, and spring means mounted relative to said first and second members for causing said bolt means to exert said pulling force on said second end edge portion when said first and second members are in said relatively remote position and for releasing said pulling force when said first and second members are in said relatively close position.

21. A vibratory screening machine as set forth in claim 20 wherein said first securing means comprise second quick release tensioning means of substantially the same construction as said quick release tensioning means for securing said second end edge portion relative to said second side wall.

22. A vibratory screening machine as set forth in claim 21 including block means on said second side wall for being engaged by said second end edge portion of said vibratory screen when said first and second members of said quick release tensioning means are in said relatively remote position.

23. A vibratory screening machine as set forth in claim 20 including means for aligning said at least said second end edge portion relative to said bed of said machine in a direction longitudinally of said second side wall.

24. A vibratory screening machine as set forth in claim 23 including means for aligning said first end edge portion relative to said bed of said machine in a direction longitudinally of said first side wall.

25. A vibratory screening machine as set forth in claim 20 wherein said screen includes side edge portions, and balloon means between at least one of said side edge portions of said screen and said bed.

26. A vibratory screening machine as set forth in claim 25 wherein said balloon seal means is between all of said side edge portions and said bed.

27. A vibratory screening machine as set forth in claim 20 wherein said relatively close and relatively remote positions of said first and second members are located within a three hundred and sixty degree relative rotation therebetween so that said relatively close and relatively remote positions occur within a single turn of one of said first and second members.

28. An alignment structure for a screen of a vibratory screening machine comprising a vibratory screen, channel means on the end of said vibratory screen, a drawbar, flange means on said drawbar for entering said channel means, and interfitting means between said channel means and said flange means for aligning said channel means with said flange means, said interfitting means comprising cooperating tab means and notch means.

29. An alignment structure as set forth in claim 28 wherein said tab means is located on said flange means, and wherein said notch means is located on said channel means.

30. An alignment structure for a screen of a vibratory screening machine as set forth in claim 28 wherein said vibratory screen includes side edge portions, and balloon seal means on at least one of said side edge portions for effecting a seal between said side edge portion and a bed of said machine.

31. An alignment structure for a screen of a vibratory screening machine as set forth in claim 30 wherein said balloon seal means are on all of said side edge portions.

* * * * *

UNITED STATES PATENT AND TRADEMARK OFFICE

CERTIFICATE OF CORRECTION

PATENT NO. : 5,332,101

DATED : July 26, 1994

INVENTOR(S) : John J. Bakula

It is certified that error appears in the above-indentified patent and that said Letters Patent is hereby corrected as shown below:

Column 13, line 14 (claim 11), after "drawbar" insert --means--;
line 15 (claim 11), cancel "and";
lines 17-18 (claim 11), cancel "for aligning said channel means with said flange means".

Column 14, line 34 (claim 20), cancel "to".

Column 15, line 3 (claim 25), after "balloon" insert --seal--.

Signed and Sealed this

Eleventh Day of October, 1994

*Attest:*

Bruce Lehman

BRUCE LEHMAN

*Attesting Officer*

*Commissioner of Patents and Trademarks*